US009062849B2

(12) United States Patent
Gennetten et al.

(10) Patent No.: US 9,062,849 B2
(45) Date of Patent: Jun. 23, 2015

(54) LED LUMINAIRE HAVING GROOVED MODIFIER

(71) Applicants: Landon Brooks Gennetten, Atlanta, GA (US); Anthony Ryan Gibbs, Atlanta, GA (US); James Richard Christ, Peachtree City, GA (US)

(72) Inventors: Landon Brooks Gennetten, Atlanta, GA (US); Anthony Ryan Gibbs, Atlanta, GA (US); James Richard Christ, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 197 days.

(21) Appl. No.: 13/706,047

(22) Filed: Dec. 5, 2012

(65) Prior Publication Data

US 2014/0153235 A1 Jun. 5, 2014

(51) Int. Cl.

| | |
|---|---|
| ***F21V 5/04*** | (2006.01) |
| ***F21V 5/02*** | (2006.01) |
| *F21Y 101/02* | (2006.01) |
| *F21Y 105/00* | (2006.01) |

(52) U.S. Cl.

CPC ... *F21V 5/04* (2013.01); *F21V 5/02* (2013.01); *F21Y 2101/02* (2013.01); *F21Y 2105/001* (2013.01)

(58) Field of Classification Search

CPC ..... F21V 3/02; F21V 5/046; F21V 5/048; F21Y 2105/001; F21W 2131/103; G02B 3/04

USPC ..... 362/145, 249.01, 249.02, 249.13, 294, 362/311.01, 311.02, 363, 373, 307, 308, 362/309, 310, 800

See application file for complete search history.

(56) References Cited

U.S. PATENT DOCUMENTS

| | | | | |
|---|---|---|---|---|
| 563,836 | A | 7/1896 | Blondel et al. | |
| 823,620 | A * | 6/1906 | Mygatt | 362/340 |
| 2,416,853 | A * | 3/1947 | Smally | 362/309 |
| 3,278,743 | A * | 10/1966 | Franck | 362/339 |
| 3,766,375 | A * | 10/1973 | Edman et al. | 362/309 |
| 4,462,068 | A * | 7/1984 | Shadwick | 362/340 |
| 5,434,765 | A * | 7/1995 | Kelly et al. | 362/308 |
| 6,027,231 | A * | 2/2000 | Fouke | 362/309 |
| D425,652 | S | 5/2000 | Brok | |
| 6,220,722 | B1 | 4/2001 | Begemann | |
| 7,025,476 | B2 | 4/2006 | Leadford | |
| 7,600,894 | B1 | 10/2009 | Simon | |
| 7,784,973 | B2 * | 8/2010 | Zhang et al. | 362/311.02 |
| 7,922,370 | B2 * | 4/2011 | Zhang et al. | 362/311.02 |
| 8,052,307 | B2 * | 11/2011 | Bak et al. | 362/311.02 |
| 8,267,552 | B2 * | 9/2012 | Hu | 362/311.02 |

(Continued)

FOREIGN PATENT DOCUMENTS

CN 102748706 10/2012

OTHER PUBLICATIONS

International Search Report for PCT/US2013/072797 mailed Apr. 10, 2014.

*Primary Examiner* — Ismael Negron

(74) *Attorney, Agent, or Firm* — King & Spalding LLP

(57) ABSTRACT

A lighting system includes an array of domed light emitting diodes covering a surface area of a substrate and two optics for processing emitted light. The first optic includes an inner surface facing the array and an exterior surface facing away from the array. The second optic includes grooves extending away from the array. The inner surface of the first optic can form a cavity that is large relative to the array. For example, the cavity can have a volume exceeding the volume of a cube, where each side of the cube has the surface area of the array.

18 Claims, 8 Drawing Sheets

(56) References Cited

U.S. PATENT DOCUMENTS

| | | | | |
|---|---|---|---|---|
| 8,382,347 | B2 * | 2/2013 | McCanless | 362/431 |
| D683,065 | S | 5/2013 | Tuck | |
| 8,632,220 | B2 * | 1/2014 | Lee | 362/294 |
| 2002/0051363 | A1 | 5/2002 | Arumugasaamy et al. | |
| 2008/0100773 | A1 | 5/2008 | Hwang et al. | |
| 2010/0039810 | A1 | 2/2010 | Holder et al. | |

* cited by examiner

LED LUMINAIRE HAVING GROOVED MODIFIER

FIELD OF THE TECHNOLOGY

The field of the technology relates generally to illumination systems and more specifically to an illumination system that includes an array of light emitting diodes ("LEDs") and at least two optics that process light emitted by the array of light emitting diodes, as may be useful for exterior lighting.

BACKGROUND

Light emitting diodes are useful for indoor and outdoor illumination, as well as other applications. Many such applications would benefit from an improved technology for managing light produced by a light emitting diode, such as forming an illumination distribution matched or tailored to application parameters.

For example, consider lighting an area with an array of light emitting diodes pointing downward, towards the ground. With many conventional light emitting diodes, the resulting illumination pattern would be relatively concentrated on the ground. However, efficiently spreading the light to provide a larger illumination area would be beneficial for many applications.

Need for improved light management is apparent. Need exists for a robust apparatus to manage light emitted by one or more light emitting diodes. Need further exists for an economical apparatus to manage light emitted by an array of light emitting diodes. Need further exists for a technology that can efficiently manage light emitted by one or more light emitting diodes, resulting in energy conservation. Need further exists for an optical device that can transform light emanating from a two-dimensional array of light emitting diodes into a desired distribution, for example redirecting light that is concentrated in one area so that the illuminated area is expanded. A capability addressing one or more such needs, or some other related deficiency in the art, would support cost effective deployment of light emitting diodes in lighting and other applications.

SUMMARY

An apparatus can process light emitted by one or more light emitting diodes to form a desired illumination distribution, for example converting light that is concentrated in one direction into a spread of light conducive to illuminating a relatively large area.

In one aspect of the present technology, a lighting system can comprise one or more light emitting diodes and two optics oriented to process emitted light. A first optic can comprise a cavity facing the light emitting diodes for subjecting emitted light to a first level of processing. A second optic can subject emitted light to a second level of processing. The second optic can comprise grooves extending lengthwise along an optical axis of the lighting system.

In another aspect of the present technology, a lighting system can comprise an array of light emitting diodes and an optic positioned to process light emitted by the light emitting diodes. The array can be distributed across a surface area, for example on a substrate. The optic can comprise a cavity that faces the array of light emitting diodes and receives light from the light emitting diodes. The optic can further comprise an outer surface that faces away from the array of light emitting diodes and that emits the received light. The cavity can be large relative to the array of light emitting diodes. For example, the cavity can have a volume exceeding the volume of a cube, where each face of the cube has a surface area equal to the surface area of the array. The optic can be utilized in the lighting system either with or without a secondary optic.

The foregoing discussion of managing light is for illustrative purposes only. Various aspects of the present technology may be more clearly understood and appreciated from a review of the following detailed description of the disclosed embodiments and by reference to the drawings and the claims that follow. Moreover, other aspects, systems, methods, features, advantages, and objects of the present technology will become apparent to one with skill in the art upon examination of the following drawings and detailed description. It is intended that all such aspects, systems, methods, features, advantages, and objects are to be included within this description, are to be within the scope of the present technology, and are to be protected by the accompanying claims.

BRIEF DESCRIPTION OF THE DRAWINGS

FIG. 1, are side-, back-, top-, and bottom-view illustrations of a lighting system according to certain exemplary embodiments of the present technology.

FIG. 2, are exploded or assembly illustrations, in two perspective views, of a lighting system according to certain exemplary embodiments of the present technology.

FIG. 10, are simulated illuminance iso-footcandle plots for a lighting system meeting a 4000 lumen specification according to certain exemplary embodiments of the present technology.

Figure 1A:
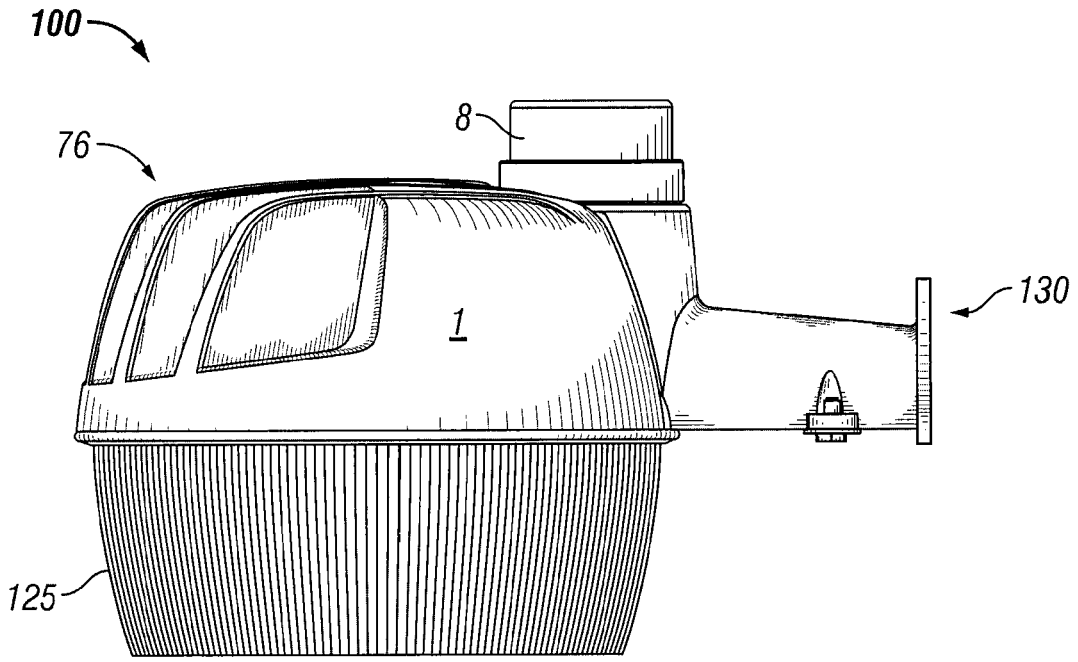
FIGS. 1A, 1B, 1C, and 1D, collectively
Figure 1B:
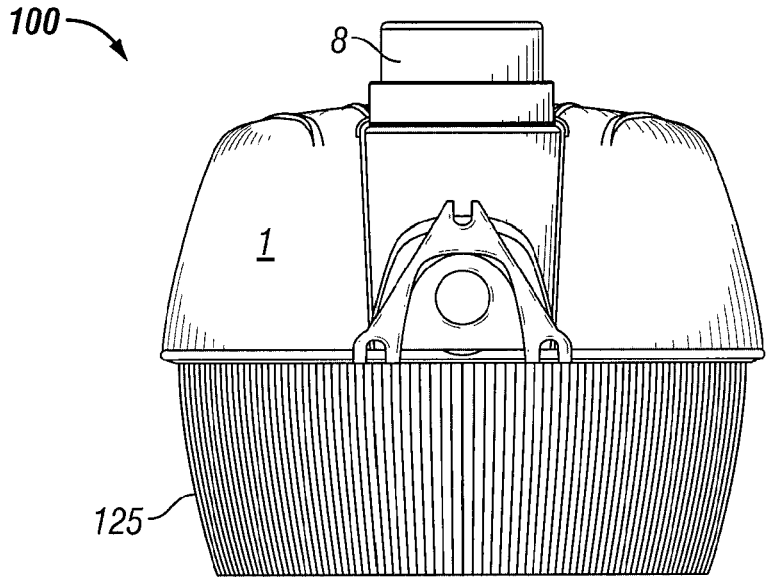
Figure 1C:
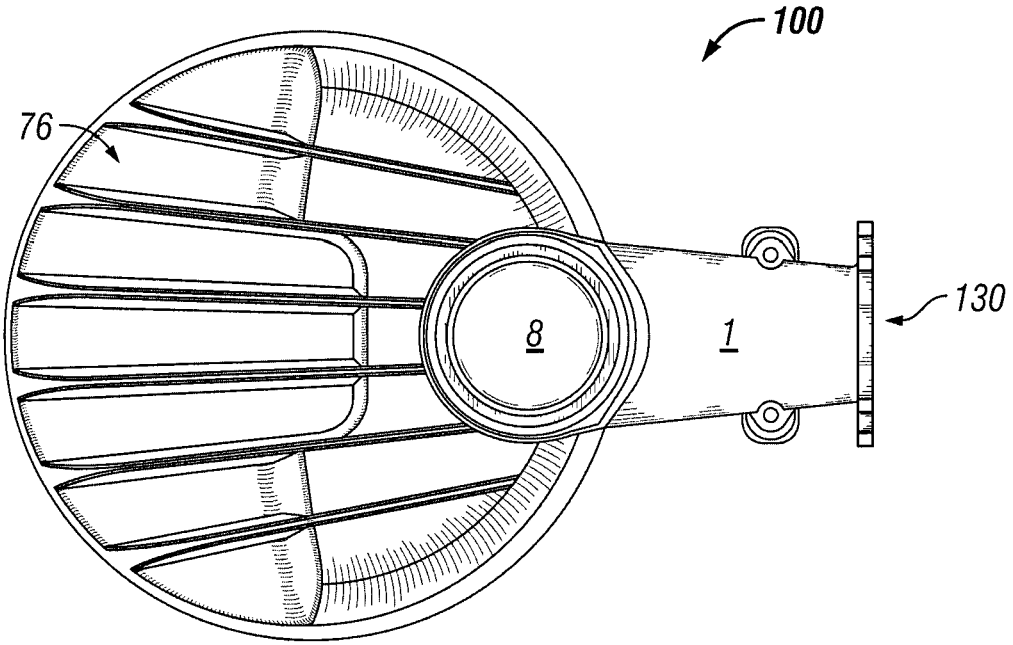
Figure 1D:
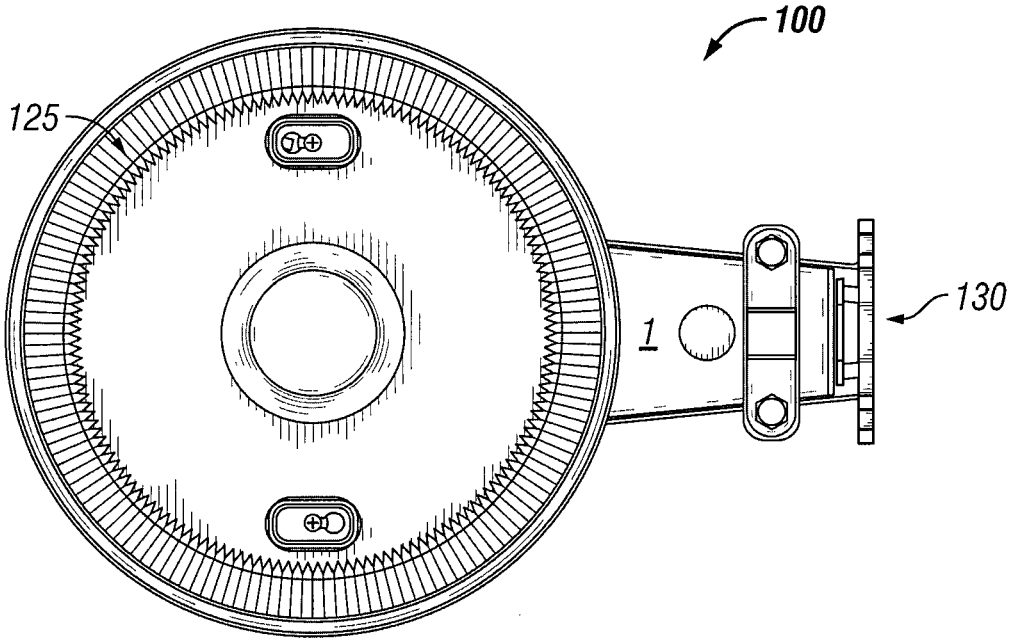

Many aspects of the technology can be better understood with reference to the above drawings. The elements and features shown in the drawings are not necessarily to scale, emphasis instead being placed upon clearly illustrating the principles of exemplary embodiments of the present technology. Moreover, certain dimensions may be exaggerated to help visually convey such principles. In the drawings, reference numerals designate like or corresponding, but not necessarily identical, elements throughout the several views.

DESCRIPTION OF EXEMPLARY EMBODIMENTS

A light generator can emit light. In certain embodiments, the light generator can be or comprise one or more light emitting diodes, such as an array of light emitting diodes. The light generator can emit light that presents a circular or elliptical illumination distribution on an illuminated surface. With an appropriately configured optical system, the light generator can be deployed in applications where an expanded illumination distribution is desired, for example to light a larger area. Thus, the optical system can process light emitted by the light generator to provide a larger illumination distribution on the surface, such as substantially increasing the diameter of a circular illuminance iso-footcandle line or magnifying an elliptical pattern.

In certain embodiments, such an optical system can receive light from an array of light emitting diodes, where each light emitting diode has an associated dome. The array can extend in two dimensions on a substrate, thereby covering a surface area of the substrate with a footprint. (The term "footprint," as used herein, refers to the surface space occupied by something, including interstitial spaces where a group of things are occupying surface space.) The array can be coupled to an optic comprising a cavity that receives light from the domes and an outer surface that emits the received light. For example, the domes can protrude into or be disposed in the cavity of the optic. The cavity can be sized to accommodate the array.

In certain embodiments, the cavity can have a volume that is large relative to the array. For example, suppose each face of a cube had a surface area equal to the footprint of the array. In certain embodiments, the cavity's volume can exceed the volume of such a cube. In certain embodiments, the cavity can be sufficiently large so that such a cube could fit inside the cavity. In certain embodiments, the cavity can be sized such that at least one edge of such a cube could fit in the cavity. In certain embodiments, at least one dimension of the array could fit in the cavity.

In certain embodiments, the optic having the cavity is a primary optic and is coupled to a secondary optic. Thus, the array of light emitting diodes can be coupled to an optical system comprising a primary optic and a secondary optic. In certain embodiments, the secondary optic comprises a pattern of grooves that extend along an optical axis. Light emitted from the primary optic can encounter the secondary optic and be expanded to spread the light and provide a broadened pattern of light as may be useful to illuminate a large area, among other applications.

Technology for managing light emitted by an array of light emitting diodes or will now be described more fully with reference to FIGS. 1-11, which describe representative embodiments of the present technology. FIGS. 1-9 describe features and elements of a representative lighting system, while FIG. 10 describes representative light output characteristics for the system. FIG. 11 describes representative light output characteristics for another system having a lower lumen specification.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 2A:
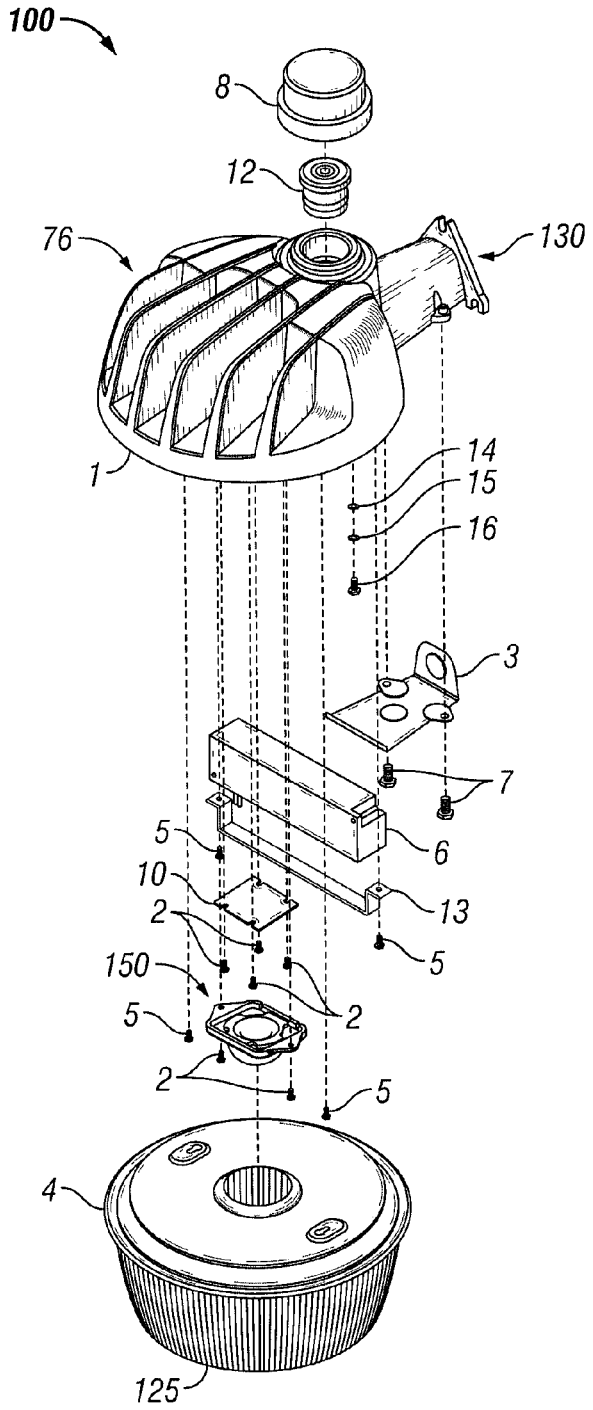
FIGS. 2A and 2B, collectively
Figure 2B:
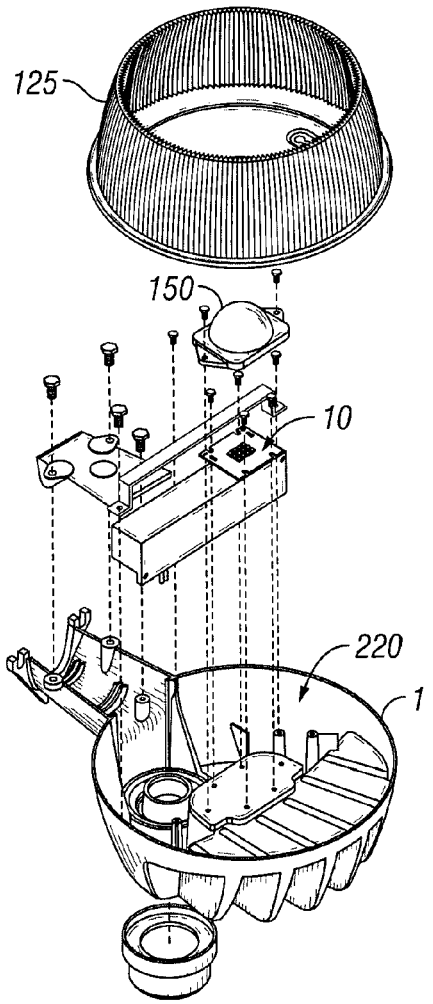

FIGS. 1 and 2 will now be discussed. FIG. 1 illustrates side, back, top, and bottom views of an exemplary lighting system 100 in accordance with certain embodiments of the present technology. FIG. 2 illustrates, in two perspective views, the lighting system 100 in an exemplary exploded or assembly form in accordance with certain embodiments of the present technology. In the illustrated embodiment, the lighting system 100 can be characterized as an exterior luminaire or an outdoor luminaire.

As illustrated, the lighting system 100 comprises a housing 1 that includes a bracket 130 for mounting to a wall or other site. Fasteners 7 attach an arm cover bracket 3 to the underside of the housing 1, as part of the mounting bracket 130. Heat sink fins 76 carry heat associated with internal electronics away from the lighting system 100.

A photocell 8 provides automatic cut-on at dusk and cutoff at dawn. A socket 12 connects the photocell 8 to the lighting system 100. When the lighting system 100 is deployed indoors, the photocell 8 may be bypassed or eliminated.

The lighting system 100 comprises a light emitting diode module 10 that produces light as will be discussed in further detail below. A primary optic 150, which will also be discussed in further detail below, processes the light produced by the light emitting diode module 10. A secondary optic 125, also discussed below, subjects the light to a second level of processing.

Fasteners 2 attach the light emitting diode module 10 and the primary optic 150 to the housing 1. The secondary optic 125 mounts to the housing 1 via a circular bracket 4, thereby positioning the secondary optic 125 in an opening or aperture 220 of the housing.

A bracket 13 and associated fasteners 5 mount a light emitting diode driver 6 to the housing 1. The light emitting diode driver 6 transforms line power to a form suitable for powering the light emitting diode module 10. A grounding contact 14 mounts to the housing 1 via a fastener 16 and an associated lock washer 15.

Figure 3:
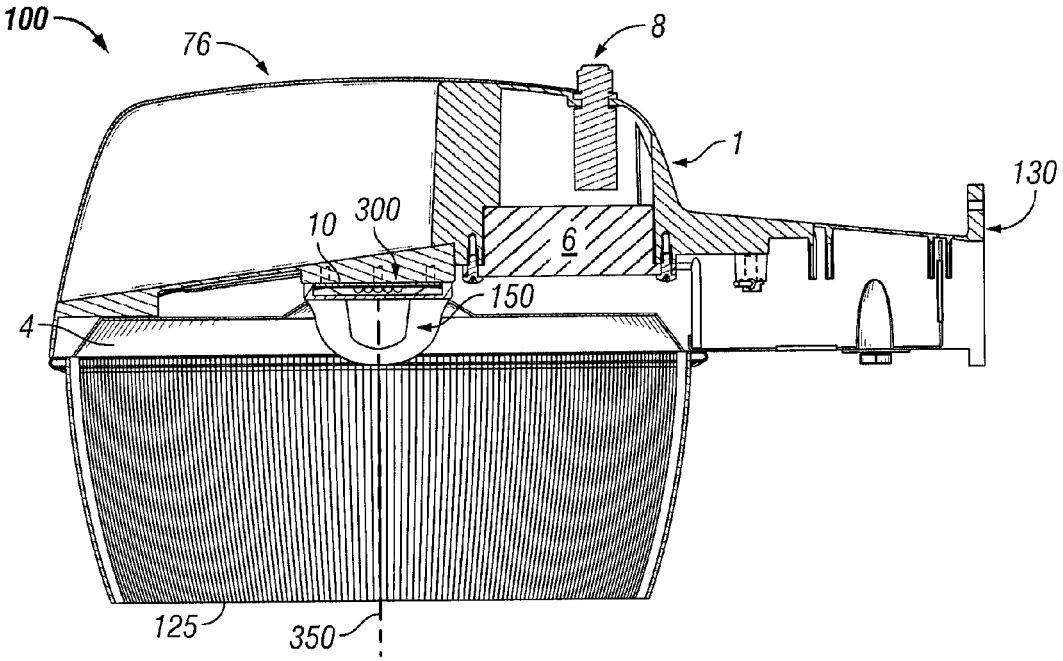
FIG. 3 is partial cutaway illustration of a lighting system, taken along a mounting bracket of the lighting system, according to certain exemplary embodiments of the present technology.

Referring now to FIG. 3, this figure illustrates in cutaway an exemplary embodiment of the lighting system 100 in accordance with certain embodiments of the present technology.

In the exemplary embodiment shown in FIG. 3, the primary optic 150 projects or extends through the circular bracket 4, thereby positioning the primary optic 150 and the secondary optic 125 to collaboratively spread light emitted from the light emitting diode module 10. As will be discussed in further detail below, the light emitting diode module 10 comprises an array 300 of light emitting diodes.

In the illustrated embodiment, the primary optic 150, the secondary optic 125, and the light emitting diode module 10 have a common optical axis 350. The optical axis 350 may be associated with a distribution of emitted light and/or associated with physical structure or mechanical features.

The term "optical axis," as used herein, generally refers to a reference line along which there is some degree of rotational or other symmetry in an optical system, or a reference line defining a path along which light propagates through a system or after exiting a system. Such reference lines are often imaginary or intangible lines.

In certain embodiments, the primary optic 150 has an optical axis that is laterally offset from or tilted with respect to the optical axis of the secondary optic 125. Moreover, the light emitting diode module 10 may have an optical axis that is laterally offset from or tilted with respect to the optical axis of the primary optic 150, and may further be offset or tilted relative to the optical axis of the secondary optic 125. In certain embodiments, the primary optic 150, the secondary optic 125, and the light emitting diode module 10 may have optical axes that are all laterally offset from one another or tilted relative to one another.

In certain embodiments, the light emitting diode module 10 may be of a form that lacks a composite optical axis along which there is rotational symmetry. In certain embodiments, the primary optic 150 may be of a form that lacks an optical axis along which there is rotational symmetry. In certain embodiments, the secondary optic 125 may be of a form that lacks an optical axis along which there is rotational symmetry.

In certain embodiments, the lighting system 100 incorporates the primary optic 150 without the secondary optic 125. In certain embodiments, the lighting system 100 incorporates the secondary optic 125 without the primary optic 150. Additionally, the various components and features disclosed herein may be utilized as standalone elements or integrated together to form modules or subsystems utilized in some other appropriate system or application.

The present disclosure and teaching is sufficiently rich and detailed to enable one of ordinary skill in the art to make and use a wide variety of optic embodiments by combining various features illustrated in the figures and described in text in accordance with principles of the present technology. Moreover, one of ordinary skill will be able to apply the present teaching readily to adapt the various disclosed features according to application parameters and preferences.

Figure 4:
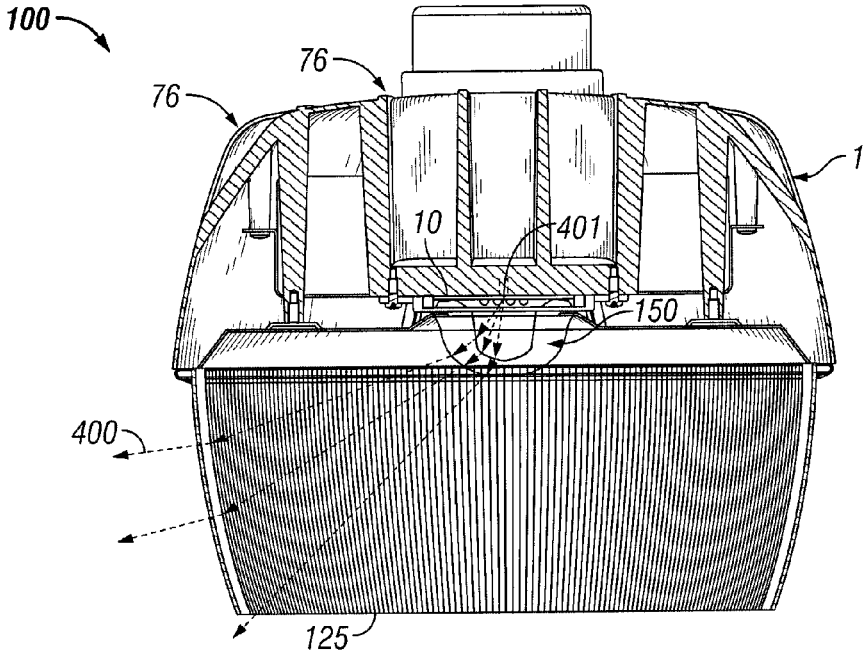
FIG. 4 is a cross sectional illustration of a lighting system, taken perpendicular to the mounting bracket of the lighting system, according to certain exemplary embodiments of the present technology.

Referring now to FIG. 4, this figure illustrates in cross section an exemplary embodiment of the lighting system 100 in accordance with certain embodiments of the present technology. FIG. 4 further illustrates exemplary rays 400 emitted by one of the light emitting diodes 401 in the light emitting diode module 10 and processed by the primary optic 150 and the secondary optic 125. The primary optic 150 and the secondary optic 125 collaboratively direct the rays 400 into a wider distribution, thereby spreading the emission pattern to facilitate expanding the area illuminated by the lighting system 100.

Figure 5A:
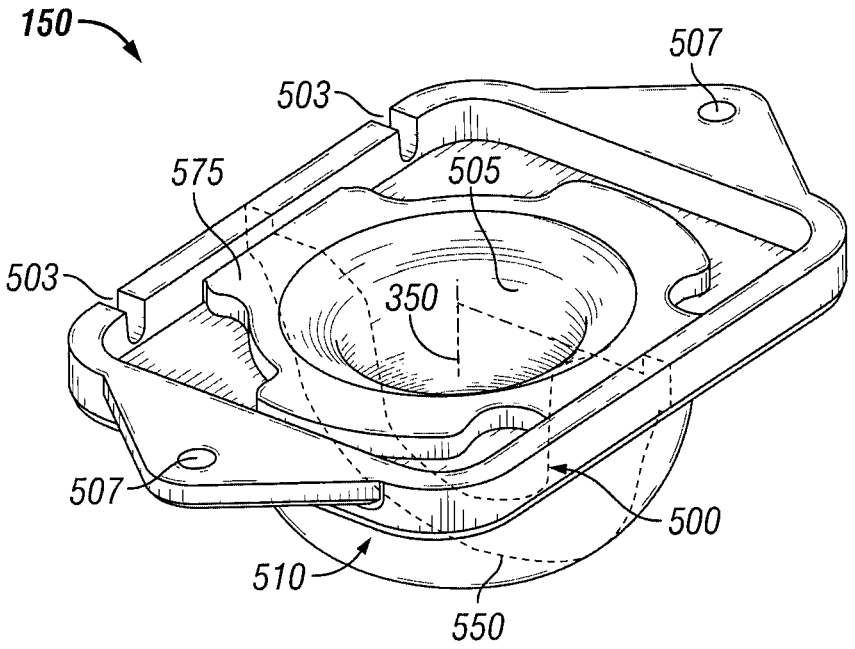
FIG. 5A is a perspective view of a primary optic for managing light emitted by an array of light emitting diodes in a lighting system, wherein the optic is depicted as opaque to promote visualization of certain surface features, according to certain exemplary embodiments of the present technology.

Referring now to FIG. 5A, this figure illustrates in perspective view an exemplary embodiment of the primary optic 150 for managing light emitted by an array 300 of light emitting diodes 401 in the lighting system 100, wherein the optic 150 is depicted as opaque to promote visualization of certain surface features, in accordance with certain embodiments of the present technology. In an exemplary embodiment, the illustrated primary optic 150 can be an element of the lighting system 100 illustrated in FIGS. 1, 2, 3, and 4 and discussed above, and will be discussed in such representative context, without limitation.

The primary optic 150 comprises an inner profile 500 and an outer profile 550 that can be defined by the intersection of a reference plane with the primary optic 150. In the illustrated embodiment, the inner profile 500 is formed at the intersection between the interior surface 505 and a reference plane in which the optical axis 350 of the primary optic 150 lies. In the illustrated embodiment, the interior surface 505 of the primary optic 150 is refractive. However, other embodiments of the interior surface 505 may utilize forms of light manipulation other than refraction, including without limitation reflection.

Similarly, the outer profile 550 is formed at the intersection between the exterior surface 510 and the reference plane containing the optical axis 350 of the primary optic 150. In the illustrated embodiment, the exterior surface 510 of the primary optic 150 is refractive. However, other embodiments of the exterior surface 550 may utilize forms of light manipulation other than refraction, including without limitation reflection As will be appreciated by those of ordinary skill having benefit of this disclosure, a "reference plane" can be thought of as an imaginary or intangible plane providing a useful aid in describing, characterizing, or visualizing something. Although illustrated in a particular position, reference planes can ordinarily be positioned in other locations that may or may not be arbitrary.

In the illustrated embodiment, the primary optic 150 comprises a combination of optically active features and optically inactive or mechanical features. The recess 575 receives the light emitting diode module 10, and the light emitting diode module 10 may be seated in the recess 575. Channels 503 facilitate passage of electrical leads. Holes 507 facilitate fastener-based mounting as discussed above with reference to FIGS. 1 and 2.

In certain exemplary embodiments, the primary optic 150 is a unitary optical element that comprises molded plastic material that is transparent. The primary optic 150 may comprise poly-methyl-methacrylate ("PMMA"), polycarbonate, or an appropriate acrylic, to mention a few representative material options without limitation. In certain exemplary embodiments, the primary optic 150 can be formed of optical grade silicone and may be pliable and/or elastic, for example.

In certain exemplary embodiments, the primary optic 150 is a seamless unitary optical element. In certain exemplary embodiments, the primary optic 150 is formed of multiple transparent optical elements bonded, fused, glued, or otherwise joined together to form a unitary optical element that is void of air gaps yet made of multiple elements.

Figure 5B:
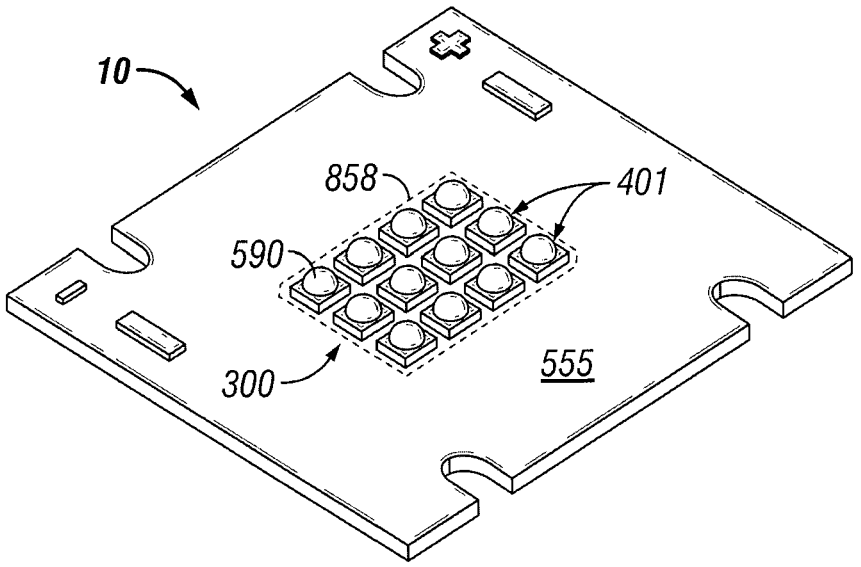
FIG. 5B is an illustration of a light emitting diode module for a lighting system according to certain exemplary embodiments of the present technology.

Referring now to FIG. 5B, this figure illustrates an exemplary embodiment of the light emitting diode module 10 for the lighting system 100 in accordance with certain embodiments of the present technology. In an exemplary embodiment, the illustrated light emitting diode module 10 can be an element of the lighting system 100 illustrated in FIGS. 1, 2, 3, and 4 and discussed above, and will be discussed in such representative context, without limitation.

In the illustrated embodiment of the light emitting diode module 10, light emitting diodes 401 are organized in an array 300 mounted to a substrate 555. In this case, the array 300 is a two-dimensional array. In various embodiments, a two-dimensional arrangement can be utilized that forms a pattern that is circular, square, rectangular, triangular, pentagon, honeycomb, or some other appropriate geometric form. In certain embodiments, a six-around-one pattern of light emitting diodes 401 can be utilized. In certain embodiments, a line of light emitting diodes 401 forming a one-dimensional array can be utilized.

As illustrated, the array 300 of light emitting diodes 401 covers a footprint 585 of the substrate 555. The footprint 585 has a surface area. In the case of a rectangular array, surface area of the footprint 585 could be computed as length of the array multiplied by width of the array, for example.

In various embodiments, the substrate 555 can be ceramic, plastic, resin, or some other electrically compatible material. The substrate 555 can comprise a circuit board, for example. In the illustrated embodiment, the substrate 555 is flat, but may be curved or have some other appropriate geometry.

In accordance with the illustrated embodiment, each light emitting diode 401 can comprise a light emitting diode package that includes a chip-level substrate and an active area that converts electrical energy into light. The active area can comprise an optoelectronic semiconductor structure or feature and/or an aperture. A dome 590 covers and protects the active area. As illustrated, the array 300 of light emitting diodes 401 comprises a corresponding array of domes 590, and the array 300 can be characterized as an array of domed light emitting diodes.

The dome 590 may comprise optical quality silicone, or some other appropriate material known in the art, that encapsulates the active area and transmits light. Thus, the dome 590 can provide environmental protection to the light emitting diode's semiconductor materials and emit the light that the light emitting diode 401 generates. In many embodiments, the dome 590 emits Lambertian light. Accordingly, the dome 590 may radiate light at highly diverse angles, for example providing a light distribution pattern that can be characterized, modeled, or approximated as Lambertian. In certain embodiments, multiple light emitting diode elements are covered by a single dome.

Figure 6:
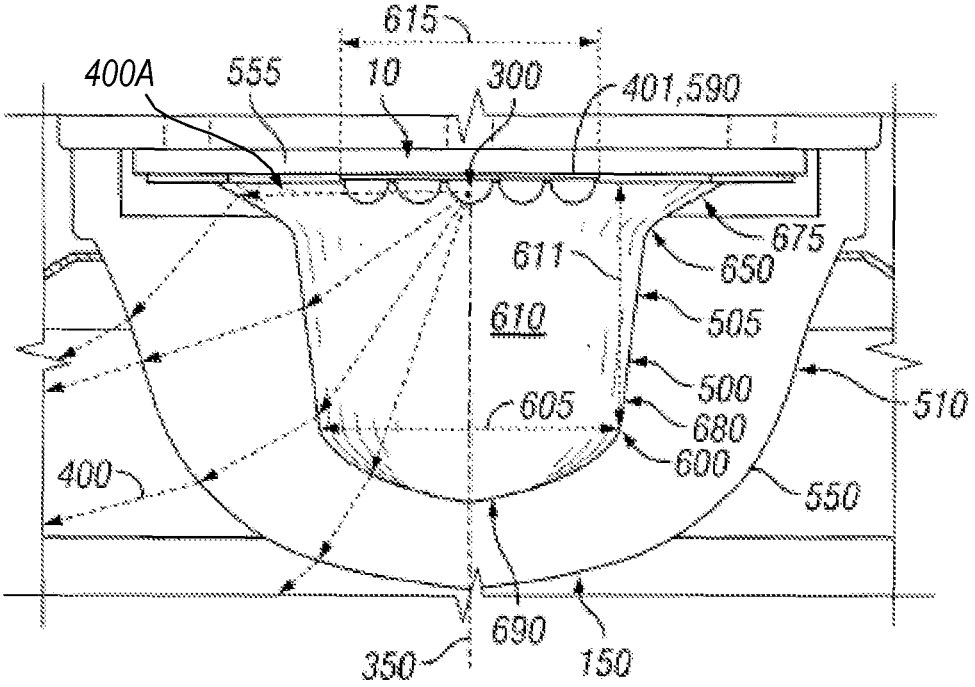
FIG. 6 is a cross sectional illustration of a primary optic and an associated array of light emitting diodes in a lighting system according to certain exemplary embodiments of the present technology.

Referring now to FIG. 6, this figure illustrates in cross section an exemplary embodiment of the primary optic 150 and associated array 300 of light emitting diodes 401 in a lighting system 100 in accordance with certain embodiments of the present technology. FIG. 6 more specifically illustrates an exemplary configuration in which the light emitting diode module 10 is mounted to the primary optic 150. The figure further illustrates representative rays 400 that are incident on and refracted first by the interior surface 505 of the primary optic 150 and second by the exterior surface 510 of the primary optic 150, which have respective profiles 500, 550 as discussed above.

In the illustrated configuration, the domes 590 of the light emitting diodes 401 project towards or into a cavity 610 of the primary optic 150. One or more of the domes 590 may extend or protrude, partially or fully, into the cavity 610, for example. In certain embodiments, the array 300 is disposed entirely in the cavity 610 of the primary optic 150. In certain embodiments, the array 300 is outside the cavity 610 of the primary optic 150.

As illustrated, the cavity 610 contains a gas such as air. However, in certain embodiments, the cavity 610 may be filled with a liquid, grease, or gel. For example, in certain embodiments, a matching gel or fluid may reduce or substantially eliminate refraction at the interior surface 505 of the primary optic 150 and at the exterior surfaces of the domes 590.

In the illustrated embodiment, the interior surface 505 of the primary optic 150 has an inner profile 500 that redirects horizontally oriented rays 400A downward and redirects other rays 400 towards horizontal. The inner profile 500 comprises a flared peripheral region 675 that provides a refractive interface for bending horizontal rays downward and that may be characterized as slanted. A sidewall region 680 of the inner profile 500 is substantially linear and bends incident rays 400 towards horizontal. The sidewall region 680 meets with the flared peripheral region 675 in a corner 650, which is a rounded corner in the illustrated embodiment. The inner profile 500 further comprises a bowl-shaped region 690 through which the optical axis 350 passes. The bowl-shaped region 690 meets with the sidewall region 680 in another corner 600, which is also a rounded corner in the illustrated embodiment.

As illustrated, the interior surface 505 provides a cavity 610 having a depth 611 and width 605. The depth 611 can be dimensioned from the top of the bowl-shaped region 690 to the closest face of the substrate 555. The width 605 can be dimensioned between the corners 600. As illustrated, the array 300 has a dimension across the page (and further as a two-dimensional array has another, perpendicular dimension that is not visible in the view of FIG. 6). The dimension will be referred to in this description below as the width 615 to promote readership, without suggesting that the opposing dimension of the array 300 is bigger or smaller.

In certain exemplary embodiments, dimensions of the cavity 610 can correlate with dimensions or footprint 585 or surface area of the array 300. For example, in certain embodiments, the width 605 of the cavity 610 is within approximately 20 percent of the width 615 of the array 300. In certain embodiments, the width 605 of the cavity 610 is approximately equal to the width 615 of the array 300. In certain embodiments, the width 605 of the cavity 610 is greater than the width 615 of the array 300.

In certain embodiments, the depth 611 of the cavity 610 is within approximately 20 percent of the width 615 of the array 300. In certain embodiments, the depth 611 of the cavity 610 is approximately equal to the width 615 of the array 300. In certain embodiments, the depth 611 of the cavity 610 is greater than the width 615 of the array 300.

In certain embodiments, the cavity 610 is large enough such that a cube can fit inside the cavity 610, where each face of the cube has the surface area of the footprint 585 of the array 300 of light emitting diodes 401. In certain embodiments, the cavity 610 has a volume that is at least as large as the volume of such a cube. In certain embodiments, the bowl-shaped region 690 of the primary optic 150 is at least as large as the footprint 585 of the array.

Figure 7:
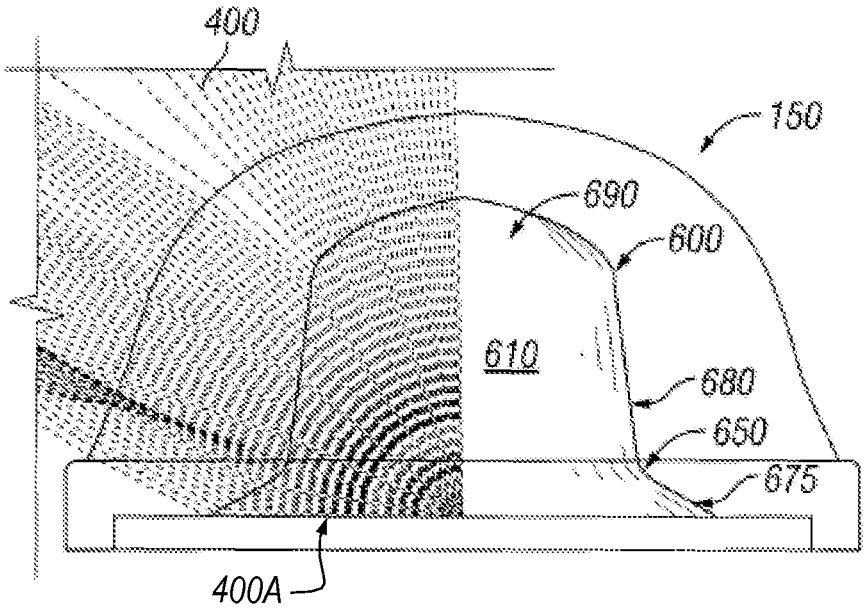
FIG. 7 is a cross sectional illustration of a primary optic and associated path traces of rays in a lighting system according to certain exemplary embodiments of the present technology.

Referring now to FIG. 7, this figure illustrates in cross section an exemplary embodiment of the primary optic 150 and associated path traces of rays 400 in the lighting system 100 in accordance with certain embodiments of the present technology. More specifically, FIG. 7 illustrates how the interior surface 505 and the exterior surface 510 of the primary optic 150 spread light rays 400 to broaden the area illuminated by the lighting system 100.

Figure 8:
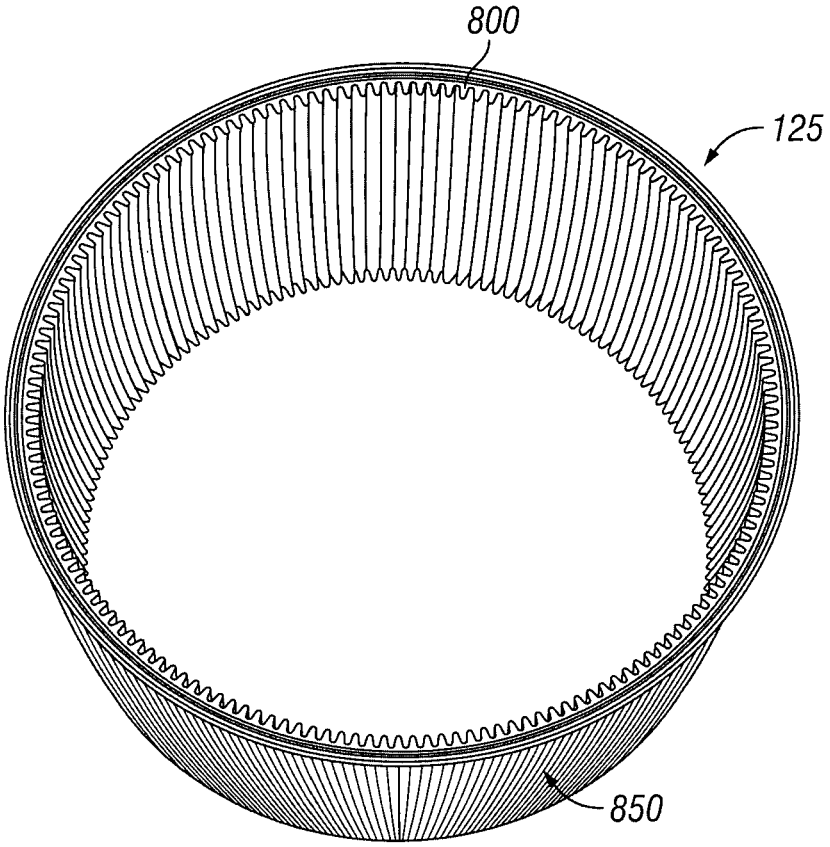
FIG. 8 is a perspective view of a secondary optic for managing light emitted by an array of light emitting diodes in a lighting system, wherein the optic is depicted as opaque to promote visualization of certain surface features, according to certain exemplary embodiments of the present technology.

Referring now to FIG. 8, this figure illustrates in perspective view an exemplary embodiment of the secondary optic 125 for managing light emitted by an array 300 of light emitting diodes 401 in a lighting system 100, wherein the optic 125 is depicted as opaque to promote visualization of certain surface features in accordance with certain embodiments of the present technology. In an exemplary embodiment, the illustrated secondary optic 125 can be an element of the lighting system 100 illustrated in FIGS. 1, 2, 3, and 4 and discussed above, and will be discussed in such representative context, without limitation.

The illustrated secondary optic 125 has two open ends, one facing the housing 1 and one opposite. On the inside, grooves 800 extend between the two ends. In various embodiments, such grooves 800 can be refractive or reflective and may comprise fluting or prismatic surfaces.

As illustrated, the outer surface 850 of the secondary optic 125 is smooth. In certain exemplary embodiments, the secondary optic 125 is a unitary optical element that comprises molded plastic material that is transparent. The secondary optic 125 may comprise PMMA, polycarbonate, or an appropriate acrylic, to mention a few representative material options without limitation. In certain exemplary embodiments, the secondary optic 125 can be formed of glass.

Figure 9:
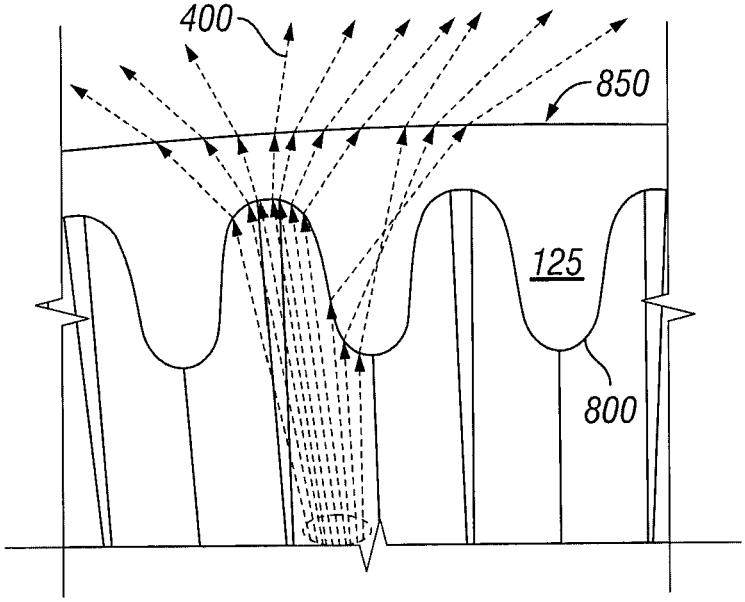
FIG. 9 is a cross sectional illustration of a portion of a secondary optic and associated path traces of rays in a lighting system according to certain exemplary embodiments of the present technology.

Referring now to FIG. 9, this figure illustrates in cross section a portion of an exemplary embodiment of the secondary optic 125 and associated path traces of rays 400 in the lighting system 100 in accordance with certain embodiments of the present technology. More specifically, FIG. 9 illustrates an exemplary embodiment of surface features of the secondary optic 125 manipulating light rays 400. As illustrated the grooves 800 in combination with the smooth outer surface 850 increase axial spread of the rays 400 utilizing refraction.

Figure 10A:
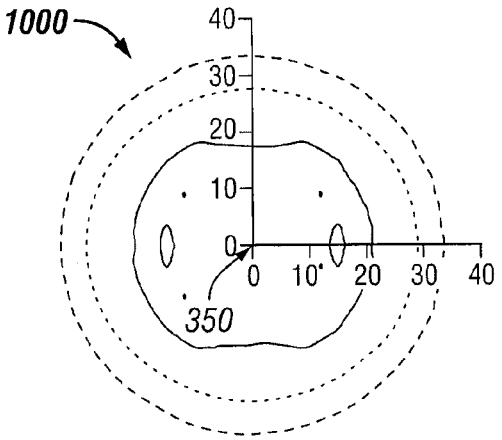
FIGS. 10A, 10B, and 10C, collectively
Figure 10B:
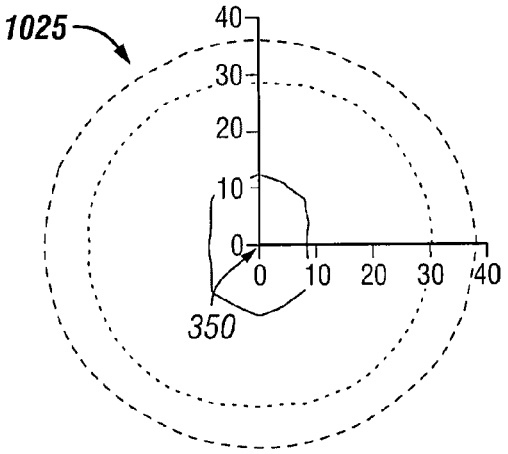
Figure 10C:
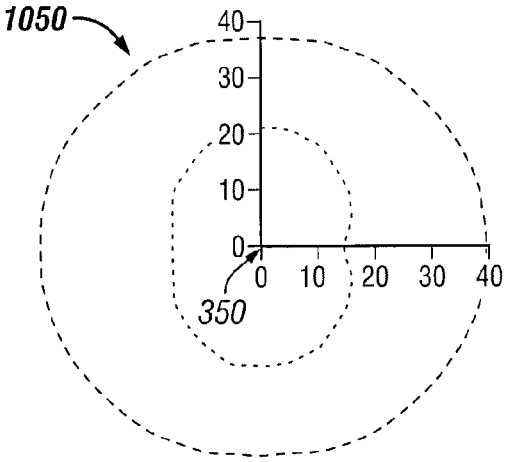
Figure 11:
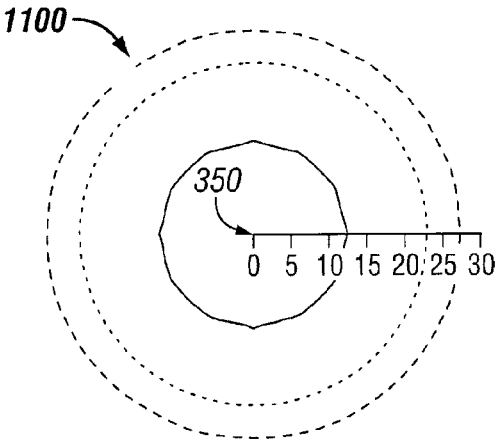
FIG. 11 is a simulated illuminance iso-footcandle plot for a lighting system meeting a 2500 lumen specification according to certain exemplary embodiments of the present technology.

Referring now to FIGS. 10A, 10B, and 10C, these figures illustrate exemplary simulated illuminance iso-footcandle plots 1000, 1025, and 1050 for a lighting system 100 meeting a 4000 lumen specification in accordance with certain embodiments of the present technology.

The plot 1000 of FIG. 10A illustrates simulated performance with the lighting system 100 mounted fifteen feet above the illuminated surface. The plot 1025 of FIG. 10B illustrates simulated performance with the lighting system 100 mounted twenty feet above the illuminated surface. The plot 1050 of FIG. 10C illustrates simulated performance with the lighting system 100 mounted twenty-five feet above the illuminated surface. The illuminated surface might be the ground, a parking lot, a grassy field, concrete, or a floor, to mention a few representative examples without limitation.

Referring now to FIG. 11, this figure illustrates an exemplary simulated illuminance iso-footcandle plot 1100 for a lighting system meeting a 2500 lumen specification in accordance with certain embodiments of the present technology. Relative to the lighting system 100 discussed above, the simulated lighting system represented in FIG. 11 may have fewer light emitting diodes and thus output less light. The plot 1100 illustrates simulated performance with the lighting system mounted fifteen feet above the illuminated surface.

Technology for managing light emitted from one or more light emitting diodes or other appropriate sources has been described. From the description, it will be appreciated that an embodiment of the present technology overcomes the limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art. Therefore, the scope of the present technology is to be limited only by the claims that follow.

What is claimed is:

1. A lighting system, for providing illumination along an axis, comprising:

a housing comprising an aperture through which the axis passes;

a substrate mounted at a position adjacent to or in the aperture;

an array of light emitting diodes mounted to the substrate and organized about the axis to emit light along the axis, the array of light emitting diodes comprising an array of domes;

a first optic comprising:

an interior surface that forms a cavity and that comprises a flared peripheral region that provides a refractive interface for bending downward horizontal rays emitted by the array of light emitting diodes; and an exterior surface opposite the interior surface, wherein the first optic is mounted adjacent the array of light emitting diodes with the axis passing through the first optic, wherein at least portions of the domes are disposed in the cavity; and a second optic comprising:

a first end oriented towards the housing and comprising a first aperture;

a second end comprising a second aperture; and a pattern of grooves extending between the first aperture and the second aperture, wherein the axis passes through the first aperture and the second aperture.

2. The lighting system of claim 1, wherein the interior surface of the first optic and the exterior surface of the first optic are rotationally symmetrical about the axis.

3. The lighting system of claim 1, wherein the second optic is rotationally symmetrical about the axis.

4. The lighting system of claim 1, wherein, the first optic has a profile defined by a cross section of the first optic taken in a plane that incorporates the axis, the profile comprising a substantially linear region that meets with a curved region to form a corner.

5. The lighting system of claim 1, wherein the interior surface comprises:

a slanted region disposed peripherally with respect to the array of light emitting diodes;

a sidewall region disposed about the axis; and a bowl-shaped region through which the axis passes.

6. The lighting system of claim 1, wherein the array of light emitting diodes extends a first distance across the substrate, and wherein, in cross section, the cavity is sized to accommodate a square having sides of length equal to the first distance.

7. A lighting system comprising:

a housing;

a planar substrate disposed in the housing;

an array of domed light emitting diodes attached to the planar substrate to cover an area of the planar substrate;

an optic comprising an interior refractive surface oriented for receiving light from the array of domed light emitting diodes and an exterior refractive surface oriented for emitting the received light;

an optical axis; and a second optic comprising grooves extending along the optical axis, wherein the interior refractive surface forms a cavity into which the array of domed light emitting diodes projects, wherein the interior refractive surface comprises a flared peripheral region for bending downward horizontal rays emitted by the array of domed light emitting diodes, and wherein the cavity has a volume that is greater than a cube having sides of surface area equal to the covered area of the planar substrate.

8. The lighting system of claim 7, wherein the cavity comprises a rounded corner disposed to receive light from the array.

9. The lighting system of claim 7, wherein the array of domed light emitting diodes comprises at least seven light emitting diodes, each having a respective dome.

10. The lighting system of claim 7, wherein the cavity is large enough so that the cube could fit in the cavity.

11. The lighting system of claim 10, wherein the interior surface comprises:

a sidewall, that is substantially flat in cross section, circumscribing an axis of the lighting system; and a bowl-shaped region through which the axis passes.

12. The lighting system of claim 11, wherein the bowl-shaped region and the substantially flat sidewall meet in a corner.

13. The lighting system of claim 12, wherein the corner is rounded.

14. A lighting fixture comprising:

a housing comprising an opening configured to face an area to be illuminated;

a first optic attached to the housing and comprising an interior surface defining a cavity and an exterior surface oriented to face the area to be illuminated;

a two-dimensional array of light emitting diodes mounted adjacent or in the cavity and oriented to emit light into the cavity; and a second optic comprising:

a first end circumscribing the first optic;

a second end opposite the first end; and refractive grooves extending between the first end and the second end, wherein the interior surface of the first optic is rotationally symmetric and comprises:

a flared peripheral region that provides a refractive interface for bending downward horizontal rays emitted by the two-dimensional array of light emitting diodes;

a bowl-shaped region; and a substantially flat sidewall disposed between the flared peripheral region and the bowl-shaped region.

15. The lighting fixture of claim 14, wherein the second optic further comprises:

an interior surface facing the first optic and comprising the refractive grooves; and an exterior surface that is substantially smooth opposite the interior surface.

16. The lighting fixture of claim 14, wherein the second end of the second optic is open, so that light emitted from the first optic includes first rays that are incident on the second optic and second rays that are oriented to illuminate the area while missing the second optic.

17. The lighting fixture of claim 14, wherein the sidewall and the bowl-shaped region meet in a corner.

18. The lighting fixture of claim 14, wherein the interior surface of the first optic has a cross sectional profile comprising an abrupt change in direction disposed between the sidewall and a bottom surface region.

* * * * *